US010539105B2

(12) United States Patent
Serra et al.

(10) Patent No.: US 10,539,105 B2
(45) Date of Patent: Jan. 21, 2020

(54) FUEL INJECTOR AND FUEL INJECTOR ASSEMBLY

(75) Inventors: Giandomenico Serra, S. Giuliano Terme (IT); Alessio Cerrai, Vicopisano (IT); Mose Gado, Nave (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 265 days.

(21) Appl. No.: 14/343,879

(22) PCT Filed: Aug. 23, 2012

(86) PCT No.: PCT/EP2012/066446
§ 371 (c)(1),
(2), (4) Date: Mar. 10, 2014

(87) PCT Pub. No.: WO2013/034450
PCT Pub. Date: Mar. 14, 2013

(65) Prior Publication Data

US 2014/0231551 A1 Aug. 21, 2014

(30) Foreign Application Priority Data

Sep. 8, 2011 (EP) ..... 11180607

(51) Int. Cl.
*F02M 61/14* (2006.01)

(52) U.S. Cl.
CPC ..... *F02M 61/14* (2013.01); *Y10T 29/49401* (2015.01)

(58) Field of Classification Search
CPC ..... F02M 61/14; F02M 2200/856; Y10T 29/49401
(Continued)

(56) References Cited

U.S. PATENT DOCUMENTS 5,520,151 A * 5/1996 Gras ..... F02M 41/14 123/469
5,934,253 A * 8/1999 Kojima ..... F02M 51/005 123/469
(Continued)

FOREIGN PATENT DOCUMENTS

CN 102834603 A 12/2012 ..... F02M 55/02
DE 102004048401 A1 4/2006 ..... F02M 61/14
(Continued)

OTHER PUBLICATIONS

European Search Report, Application No. 11180607.1, 5 pages, dated Jan. 27, 2012.
(Continued)

*Primary Examiner* — Arthur O. Hall
*Assistant Examiner* — Steven M Cernoch
(74) *Attorney, Agent, or Firm* — Slayden Grubert Beard PLLC

(57) ABSTRACT

A fuel injector may include a fuel injector body having a central longitudinal axis, a plate element for coupling the fuel injector to a fuel injector cup, a snap ring and a spring element is specified. The snap ring is operable to block a movement of the fuel injector body relative to the plate element in a first direction of the central longitudinal axis. The spring element is operable to bias the plate element in a second direction of the central longitudinal axis opposing the first direction of the central longitudinal axis to prevent a movement of the plate element relative to the fuel injector body during coupling to the fuel injector cup.

9 Claims, 3 Drawing Sheets

(58) Field of Classification Search
USPC ..... 239/584
See application file for complete search history.

(56) References Cited

U.S. PATENT DOCUMENTS

| | | | | |
|---|---|---|---|---|
| 5,970,953 | A * | 10/1999 | Lorraine | F02M 61/14 123/456 |
| 6,276,339 | B1 * | 8/2001 | Shebert, Jr. | F02M 61/14 123/470 |
| 6,539,920 | B1 * | 4/2003 | Spiers | F02M 55/004 123/456 |
| 6,718,949 | B2 * | 4/2004 | Gmelin | 123/470 |
| 7,188,611 | B2 * | 3/2007 | Schmieder | F02M 55/004 123/469 |
| 7,334,571 | B1 | 2/2008 | Beardmore | 123/470 |
| 7,360,524 | B2 * | 4/2008 | Zdroik | F02M 55/005 123/469 |
| 7,373,926 | B2 * | 5/2008 | Eckbauer | F02M 55/00 123/470 |
| 7,765,984 | B2 * | 8/2010 | Fuerst | F02M 55/025 123/456 |
| 7,802,559 | B2 | 9/2010 | Fürst et al. | 123/470 |
| 7,874,282 | B2 * | 1/2011 | Ghelardi | F02M 55/005 123/456 |
| 7,909,021 | B2 * | 3/2011 | Fujii | F02M 69/465 123/470 |
| 8,171,917 | B2 * | 5/2012 | Di Domizio | F02M 55/02 123/456 |
| 8,286,612 | B2 * | 10/2012 | Biasci et al. | 123/470 |
| 8,408,184 | B2 * | 4/2013 | Marc | F02M 55/025 123/456 |
| 8,522,753 | B2 * | 9/2013 | Malec | F02M 69/54 123/470 |
| 8,905,002 | B2 | 12/2014 | Serra et al. | 123/470 |
| 9,803,605 | B2 * | 10/2017 | Serra | F02M 55/025 |
| 2009/0056674 | A1 * | 3/2009 | Furst | F02M 61/14 123/470 |
| 2009/0173317 | A1 * | 7/2009 | Doherty | F02M 55/004 123/470 |
| 2009/0229575 | A1 * | 9/2009 | Giorgetti | F02M 55/025 123/470 |
| 2009/0229576 | A1 * | 9/2009 | Biasci et al. | 123/470 |
| 2010/0258085 | A1 * | 10/2010 | Giorgetti | F02M 55/02 123/470 |

FOREIGN PATENT DOCUMENTS

| | | | | |
|---|---|---|---|---|
| DE | 102005020380 | A1 | 11/2006 | F02M 61/14 |
| EP | 2093411 | A1 | 8/2009 | F02M 55/00 |
| EP | 2093413 | A1 | 8/2009 | F02M 55/00 |
| EP | 1892408 | B1 | 10/2009 | F02M 55/00 |
| EP | 2241746 | A1 | 10/2010 | F02M 55/00 |
| WO | 2013/034450 | A1 | 3/2013 | F02M 61/14 |

OTHER PUBLICATIONS

International Search Report and Written Opinion, Application No. PCT/EP2012/066446, 9 pages, date Oct. 18, 2012.
Chinese Office Action, Application No. 201280043791.5, 23 pages, dated Oct. 27, 2015.
Korean Office Action, Application No. 201807325728, 8 pages, dated Oct. 30, 2018.
Korean Notice of Allowance, Application No. 20147009315, 3 pages, dated Feb. 18, 2019.

* cited by examiner

FUEL INJECTOR AND FUEL INJECTOR ASSEMBLY

CROSS-REFERENCE TO RELATED APPLICATIONS

This application is a U.S. National Stage Application of International Application No. PCT/EP2012/066446 filed Aug. 23, 2012, which designates the United States of America, and claims priority to EP Application No. 11180607.1 filed Sep. 8, 2011, the contents of which are hereby incorporated by reference in their entirety.

TECHNICAL FIELD

The invention relates to a fuel injector and to a fuel injector assembly with a fuel injector and a coupling device for hydraulically and mechanically coupling the fuel injector to a fuel rail of a combustion engine.

BACKGROUND

Coupling devices for hydraulically and mechanically coupling a fuel injector to a fuel rail are in widespread use, in particular for internal combustion engines. Fuel can be supplied to an internal combustion engine by the fuel injector assembly. The fuel injector assembly has fuel injectors that can be coupled to fuel injector cups in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Fuel rails can comprise a hollow body with recesses in form of fuel injector cups. The fuel injector cups may also be hydraulically coupled to the fuel rail via pipe elements. The fuel injectors are attached to the fuel injector cups. The connection of the fuel injectors to the fuel injector cups that supply the fuel from a fuel tank via a low or high-pressure fuel pump needs to be very precise to get a correct injection angle and a sealing of the fuel.

SUMMARY

One embodiment provides a fuel injector comprising a fuel injector body having a central longitudinal axis, a plate element for coupling the fuel injector to a fuel injector cup, a snap ring and a spring element, wherein the plate element is axially movable with respect to the injector body, the snap ring is operable to block a movement of the fuel injector body relative to the plate element in a first direction of the central longitudinal axis, and the spring element is operable to bias the plate element in a second direction of the central longitudinal axis opposing the first direction of the central longitudinal axis to retain the plate element in a fix position relative to the fuel injector body during alignment of the plate element with the fuel injector cup.

In a further embodiment, the spring element comprises an annular section, the annular section being in contact with the plate element and extending completely circumferentially around the fuel injector body.

In a further embodiment, the spring element comprises at least a first leg and a second leg, wherein an end portion of the first leg is in contact with the fuel injector and an end portion of the second leg bears on the end portion of the first leg.

In a further embodiment, the spring element comprises at least a first leg and a second leg, the first leg and the second leg together form a closed round shape.

In a further embodiment, the spring element comprises at least two first legs which are arranged mirror-symmetrically with respect to a mirror plane comprising the central longitudinal axis.

In a further embodiment, the plate element has at least one axial through hole for receiving a screw or bolt.

In a further embodiment, the fuel injector comprises a shoulder extending in radial direction and the spring element is arranged axially between the shoulder and the plate element.

In a further embodiment, each of the spring element and the shoulder is of a material which comprises a metal, and the shoulder and the spring element form a metal to metal contact area.

In a further embodiment, the plate element comprises a groove, and the snap ring is arranged in the groove.

Another embodiment provides a fuel injector assembly with any of the fuel injectors disclosed above and a coupling device for hydraulically and mechanically coupling the fuel injector to a fuel rail of a combustion engine, the coupling device comprising a fuel injector cup being designed to be hydraulically coupled to the fuel rail and to be in engagement with a fuel inlet portion of the fuel injector, wherein the injector cup is fixedly coupled to the plate element, the fuel injector is retained in the fuel injector cup in direction of the central longitudinal axis and a movement of the fuel injector relative to the fuel injector cup in a first direction of the central longitudinal axis is blocked by means of mechanical interaction of the fuel injector body with the fuel injector cup via the plate element and the snap ring.

In a further embodiment, the spring element is operable to prevent a movement of the fuel injector relative to the fuel injector cup in a second direction of the central longitudinal axis opposing the first direction of the central longitudinal axis by means of mechanical interaction of the fuel injector body with the fuel injector cup via plate element and the spring element.

In a further embodiment, the injector cup is fixedly coupled to the plate element by means of screws or bolts extending in direction of the central longitudinal axis.

Another embodiment provides a method for assembling a fuel injector assembly including assembling a fuel injector as disclosed above and subsequently coupling a fuel injector cup to the plate element.

BRIEF DESCRIPTION OF THE DRAWINGS

Example embodiments of the invention are explained below with reference to the drawings, in which.

DETAILED DESCRIPTION

Figure 1:
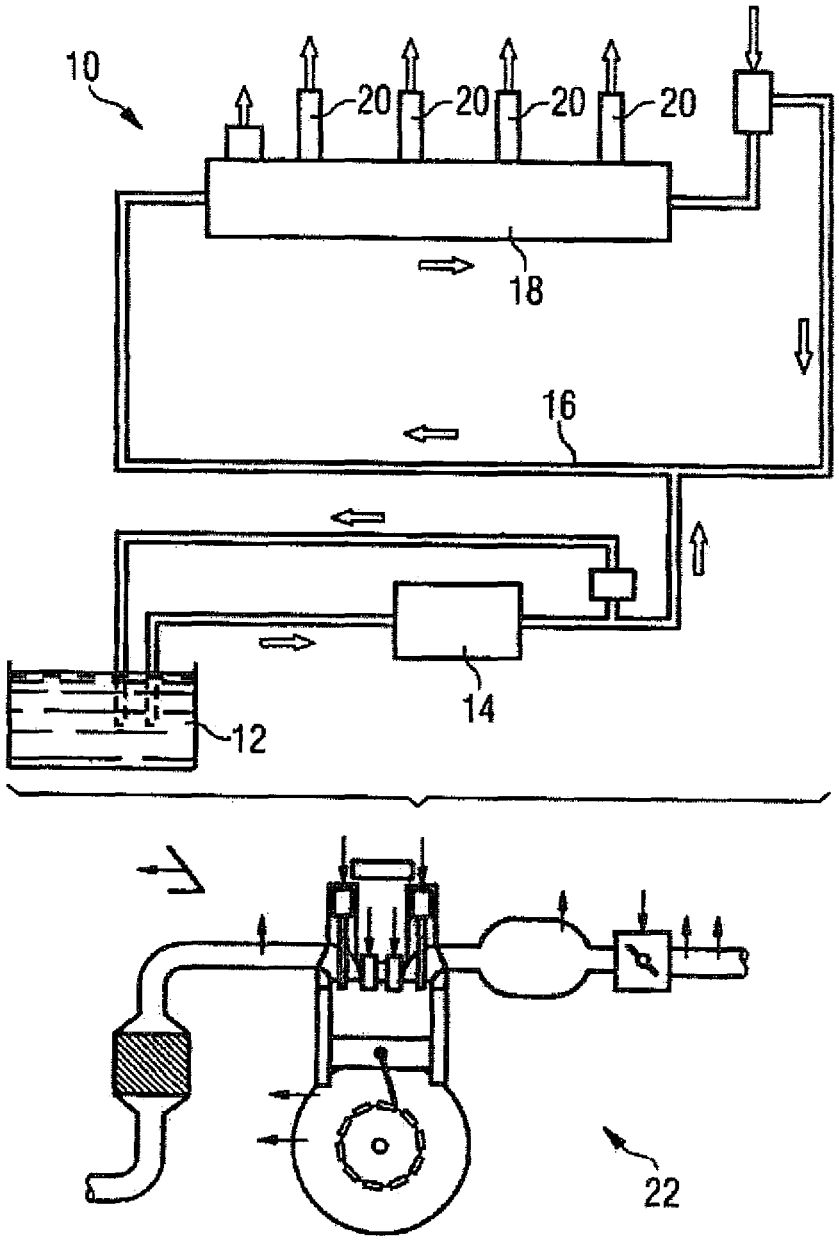
FIG. 1 shows an internal combustion engine in a schematic view.

Some embodiments provide a fuel injector which is easily connectable to a coupling device.

Further, some embodiments provide a fuel injector assembly with a fuel injector and a coupling device for hydraulically and mechanically coupling the fuel injector to a fuel rail, wherein the fuel injector assembly is simply to be manufactured and facilitates a reliable and precise connection between the fuel injector and the fuel injector cup without a resting of the fuel injector on the cylinder head.

Some embodiments provide a fuel injector. Other embodiments provide a fuel injector assembly with a fuel injector and a coupling device. The coupling device may be provided for hydraulically and mechanically coupling the fuel injector to a fuel rail of a combustion engine. The coupling device may comprise a fuel injector cup which may be designed to be hydraulically coupled to the fuel rail and to engage a fuel inlet portion of the fuel injector.

The fuel injector may comprise an injector body having central longitudinal axis. It may further comprise a plate element, a snap ring and a spring element.

The plate element may expediently be provided for being fixedly coupled to the fuel injector cup. In case of the fuel injector assembly, it is fixedly coupled to the fuel injector cup. The plate element—except for the interaction with the snap ring and the spring element—is axially movable with respect to the injector body. For example, the plate element has a central opening through which the injector body extends.

The snap ring is designed to block a movement of the injector body relative to the plate element in a first direction of the central longitudinal axis, in particular by means of direct mechanical interaction—e.g. a form fit—of the injector body, the snap ring and the plate element. For example, the plate element comprises a groove and the snap ring is arranged in the groove. In this way, the snap ring may be provided for fixedly coupling the plate element to the injector body and in particular to retain the fuel injector in the fuel injector cup in direction of the central longitudinal axis.

The spring element may be expediently operable to bias the plate element in a second direction direction of the central longitudinal axis, opposing the first direction of the central longitudinal axis, with respect to the injector body. In other words, taking the plate element as a reference, the spring element may bias the injector body in the first direction with respect to the plate element. In this way, movement of the injector body relative to the plate element in the second direction may be prevented in the case of the assembled fuel injector assembly.

Preferably, the plate element is pressed against the snap ring by means of the spring element. The plate element and the injector body may be positionally fixed with respect to each other in this way. Thus, connecting the fuel injector cup may be particularly easy. When aligning the fuel injector cup with respect to the plate element for coupling the fuel injector cup to the plate element, positioning of the plate element with respect to the fuel injector cup may be particularly easy and reliable.

A movement of the fuel injector relative to the fuel injector cup may be prevented in both directions of the central longitudinal axis by means of the snap ring and the spring element. The spring element may be easily mounted. Furthermore, the spring element does not exert additional forces on the fuel injector.

The spring element may be arranged axially between the injector body and the plate element. For example, the injector body comprises a shoulder extending in radial direction and the spring element is arranged axially between the shoulder and the plate element. This has the advantage that the shoulder offers a secure supporting surface for the spring element.

In a further embodiment the spring element is of a material which comprises a metal. This has the advantage that the spring element may have a very high mechanical stability, in particular in view of the long term stability.

In a further embodiment the shoulder is of a material which comprises a metal, and the shoulder and the spring element forma metal to metal contact area. This has the advantage that the spring element and the shoulder may have a very high mechanical stability at the contact area, in particular in view of long term aspects.

In a further embodiment the spring element comprises an annular section. The annular section is in particular in contact with the plate element. This has the advantage that a simple construction of the spring element is possible. Furthermore, a fast and secure coupling of the fuel injector to the fuel injector cup is possible.

In a further embodiment the fuel injector is arranged inside the annular section. The annular section preferably extends completely circumferentially around the injector body. In this way, a correct position of the plate element may be assured during mounting the injector cup. In particular, the risk of the plate element for moving out of the desired mounting position is reduced as compared to a spring element without a completely circumferential annular section. It is a further advantage that the spring element may be coupled undetachably to the fuel injector.

In another development, an outer circumferential surface of the annular section has a plurality of grooves, which are extending in axial direction. The grooves are in particular designed to engage connection elements like screws which are used to fix the injector cup with the plate element. Particularly small radial dimensions of the plate element and the injector cup are achievable in this way. In a further development, the number of grooves is a multiple of the number of connection elements. With advantage, the fuel injector and the injector cup can be fixed to each other in a plurality of angular positions with respect to each other.

In a further embodiment the spring element comprises at least one leg, wherein the at least one leg is in contact with the fuel injector. This has the advantage that a good force transmission between the fuel injector and the spring element may be achieved.

In a further embodiment the spring element comprises a plurality of legs, and at least two of the legs are arranged symmetric with respect to the central longitudinal axis of the fuel injector. For example, the spring element has mirror symmetry with respect to a mirror plane comprising the central longitudinal axis. In a further embodiment, the spring element has a first leg and a second leg which are arranged on opposite sides of the central longitudinal axis in a side view of the fuel injector. Each of the first and second leg has a first end portion which is anchored with the annular section and a second end portion remote from the annular section. In the course from the first to the second end portions, the respective leg may have, a U-shape or V-shape, the openings of the U-shapes or V-shapes of the first and second legs facing each other. In one development, the spring element has two first legs and two second legs, wherein the first legs are arranged symmetrically and the second legs are arranged symmetrically with respect to the same mirror plane.

This has the advantage that a well-balanced force transmission between the fuel injector and the plate element may be achieved. In particular, the force transmission between the fuel injector and the plate element may be symmetric relative to the central longitudinal axis of the fuel injector. Consequently, a good stress distribution between the fuel injector and the plate element may be obtained.

In one development, the second end portion of the second leg bears on the second end portion of the first leg. For example, the second end part of the second leg is operable to glide on the second end part of the first leg when the spring element is compressed or stretched. In this way, the spring element may have a satisfactory strength and at the same time particularly small radial dimensions.

According to a further aspect, a method for assembling a fuel injector assembly is disclosed. The method comprises assembling a fuel injector according to at least one of the preceding embodiments and, subsequent to assembling the fuel injector, coupling the fuel injector cup to the plate element. In particular, The spring element is compressed and the snap ring installed during assembling the fuel injector. In this way, the plate element may be pressed against the snap ring by the compressed spring element when being coupled to the fuel injector cup. A particularly precise and easy alignment of the injector cup and the plate element is achievable in this way.

FIG. 1 shows a fuel feed device 10 which is assigned to an internal combustion engine 22. The internal combustion engine 22 may be a diesel engine or a gasoline engine. The fuel feed device 10 includes a fuel tank 12 that is connected via a first fuel line to a fuel pump 14. The output of the fuel pump 14 is connected to a fuel inlet 16 of a fuel rail 18. In the fuel rail 18, the fuel is stored for example under a pressure of about 200 bar in the case of a gasoline engine or of more than 2,000 bar in the case of a diesel engine. Fuel injectors 20 are connected to the fuel rail 18 and the fuel is fed to the fuel injectors 20 via the fuel rail 18.

Figure 2:
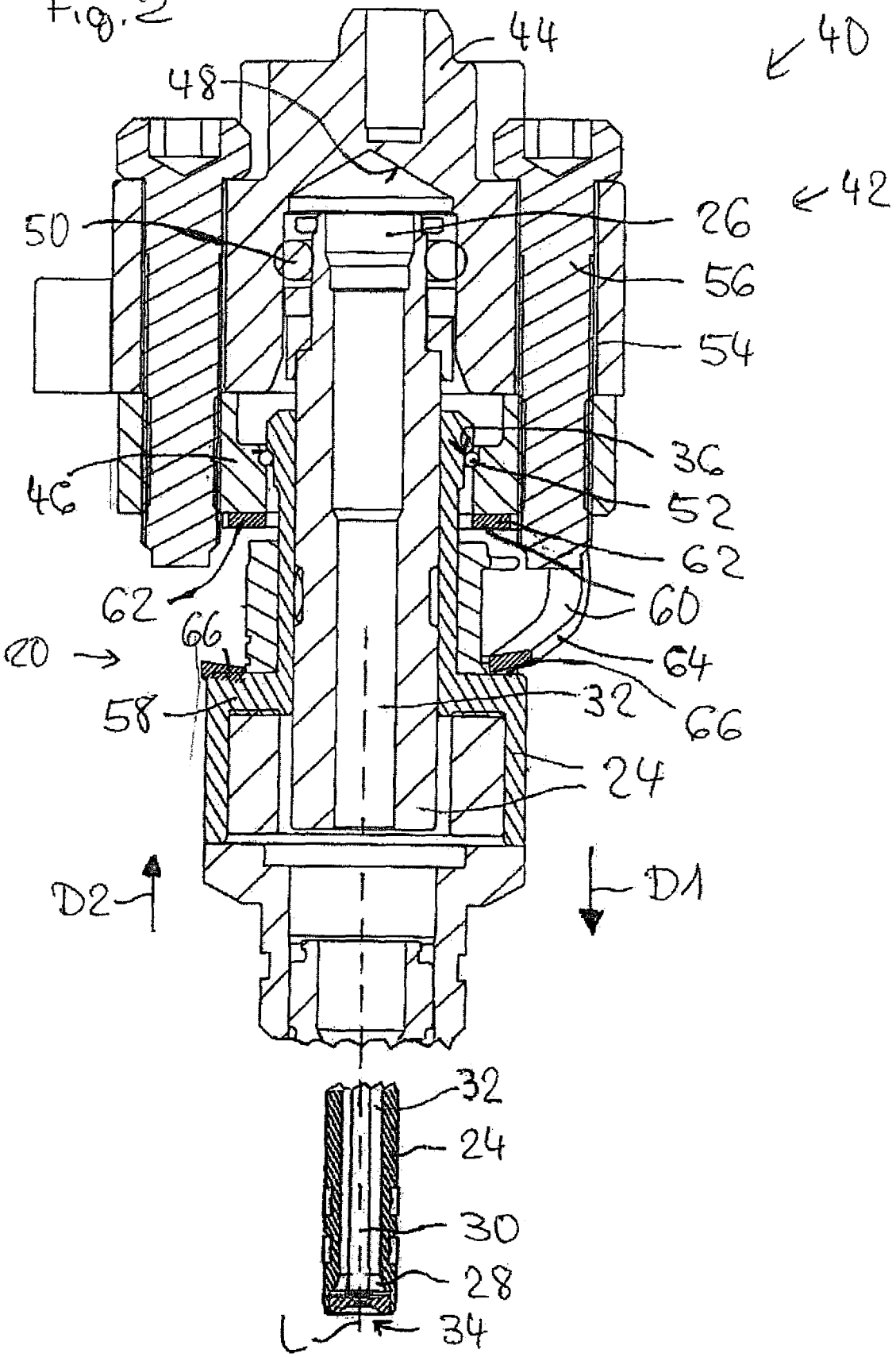
FIG. 2 shows a longitudinal section through a fuel injector assembly with a fuel injector.

FIG. 2 shows a fuel injector assembly 40 with the fuel injector 20.

The fuel injector 20 has a central longitudinal axis L. The fuel injector 20 has a fuel injector body 24 and is suitable for injecting fuel into a combustion chamber of the internal combustion engine 22. The fuel injector 20 has a fuel inlet portion 26 and a fuel outlet portion 28. The fuel inlet portion 26 of the fuel injector 20 comprises a sealing ring 50.

Furthermore, the fuel injector 20 comprises a valve needle 30 taken in a cavity 32 of the fuel injector body 24. On a free end of the fuel injector 20 an injection nozzle 34 is formed which is closed or opened by an axial movement of the valve needle 30. In a closing position a fuel flow through the injection nozzle 34 is prevented. In an opening position fuel can flow through the injection nozzle 34 into the combustion chamber of the internal combustion engine 22. The fuel injector 20 further comprises a groove 36 which is arranged at an outer surface of the fuel injector body 24.

The fuel injector 20 further comprises a plate element 46 and a snap ring 52. The snap ring 52 is arranged in the groove 36 of the fuel injector body 24. Furthermore, the plate element 46 is in engagement with the snap ring 52. Consequently, the plate element 46 is fixedly coupled to the fuel injector body 24. The snap ring 52 enables a positive fitting coupling between the plate element 46 and the fuel injector body 24 to prevent a movement of the fuel injector body 24 relative to the plate element 46 in a first direction D1.

The fuel injector 20 has a shoulder 58 which extends in radial direction. Preferably, the shoulder 58 is of a material which comprises a metal.

A spring element 60 is arranged axially between the shoulder 58 of the fuel injector 20 and the plate element 46. The shoulder 58 of the fuel injector 20 and the spring element 60 form a contact area 66. The spring element 60 presses the plate element 46 against the snap ring 52, in particular for fixing the position of the plate element 46 with respect to the position of the injector body 24 before and during mounting to the injector cup 44. This arrangement may prevent a movement of the fuel injector body 24 relative to the plate element 46 in a second direction D2 wherein the second direction D2 is contrary to the first direction D1.

Preferably, the spring element 60 is at least partially of a material which comprises a metal. If the shoulder 58 is also of a material which comprises a metal, the contact area 66 of the shoulder 58 and the spring element 60 forms a metal to metal contact area. By this a high mechanical stability at the contact area 66 between the spring element 60 and the shoulder 58 may be obtained.

Figure 3:
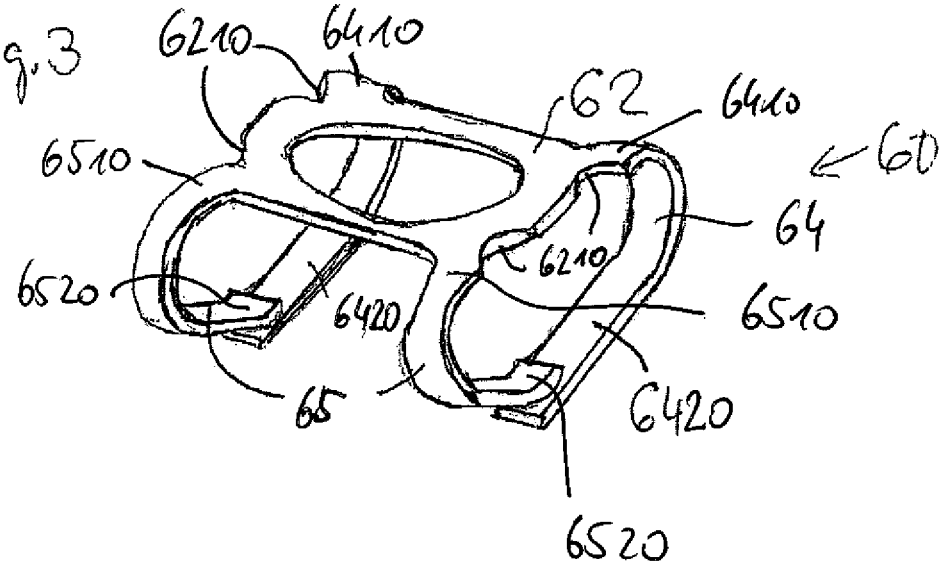
FIG. 3 shows a spring element in a perspective view.

FIG. 3 shows the spring element 60 in a detailed view. The spring element 60 has an annular section 62 and a plurality of legs 64, 65 which are fixedly coupled to the annular section 62.

The annular section 62 is in contact with the plate element 46. The fuel injector body 24 is arranged inside the annular section 62 of the spring element 60. By this the spring element 60 may be coupled undetachably to the fuel injector body 24 by means of interaction with the snap ring 52 and plate element 46.

In the shown embodiment the spring element 60 has four legs 64, two first legs 64 and two second legs 65. In further embodiments the spring element 60 may have a number of legs 64 being different of four. The number of legs 64 may depend on the requirements of the force transmission between the fuel injector 20 and the plate element 46.

The first legs 64 are in close contact with the shoulder 58 of the fuel injector 20. The second legs 65 bear on the first legs 64 and are at a distance from the shoulder 58. More specifically, the first legs have first end portions 6410 anchored with the annular section 62 and second end portions 6420, remote from the annular section 62 and contacting the shoulder 58. The second legs also have first end portions 6510 which are anchored with the annular section 62. A second end portion 6520 of each of the second legs 65 bears on the second end portion 6420 of a respective first leg 64. The second end portions 6520 of the second legs 65 may glide on the respective second end portions 6420 of the first legs when the spring element 60 is compressed or stretched.

The first and second legs 64, 65 are curved between their respective first end portion 6410, 6510 and second end portion 6420, 6520, in each case. In particular, they each have a U-shape. The openings of the U-shapes of a first leg 64 and of a second leg 65 face each other, so that each of the first legs 64 forms a closed round shape together with a respective one of the second legs 65.

Preferably, at least two of the legs 64, 65 are arranged symmetric with respect to the central longitudinal axis L of the fuel injector body 24. In the present case, the first legs 64 are arranged in mirror symmetrical fashion with respect to a mirror plane comprising the central longitudinal axis L. Further, the second legs 65 are arranged in mirror symmetrical fashion to the same mirror plane. By this the force transmission between the fuel injector body 24 and the plate element 46 may be well-balanced. In particular, the force transmission between the fuel injector body 24 and the plate element 46 may be symmetric relative to the central longitudinal axis L of the fuel injector body 24. Generally, the number of legs 64, their distribution relative to the central longitudinal axis L, their shape, width and thickness may enable a very good control of the axial position of the fuel injector body 24 with respect to the plate element 46.

The fuel injector assembly 40 further comprises a coupling device 42. The coupling device 42 may be coupled to the fuel rail 18 of the internal combustion engine 22. The coupling device 42 has a fuel injector cup 44. The fuel injector cup 44 comprises an inner surface 48 and is hydraulically coupled to the fuel rail 18. The sealing ring 50 of the fuel injector 20 enables an engagement of the fuel injector cup 44 with the fuel inlet portion 26 of the fuel injector 20.

The fuel injector cup 44 and the plate element 46 comprise through holes 54. The fuel injector cup 44 and the plate element 46 are fixedly coupled with each other by screws 56. Each of the screws 56 is received by one of the through holes 54 of the fuel injector cup 44. Each of the screws 56 is screwed into the plate element 46.

An outer circumferential surface of the annular section 62 of the spring element 60 has a plurality of grooves 6210. Each screw 56 engages one of the grooves 6210. Preferably however, there is no direct mechanical contact between the screws 56 and the spring element 60, i.e. the screws 56 may be arranged spaced apart from the outer circumferential surface in the grooves 6210.

As the plate element 46 is fixedly coupled to the fuel injector 20 by the snap ring 52 and the fuel injector cup 44 is fixedly coupled to the plate element 46 by the screw 56, the fuel injector 20 is retained in the fuel injector cup 44 in direction of the central longitudinal axis L.

In the following, the assembly of the fuel injector 20 and of the fuel injector assembly 40 is described:

For assembling the fuel injector 20, the fuel injector body 24 is arranged inside the annular section 62 of the spring element 60. Furthermore and in particular subsequently, the plate element 46 is shifted over the fuel injector body 24 until the plate element 46 is in contact with the annular section 62 of the spring element 60, and at least one of the legs 64 is in contact with the shoulder 58 of the fuel injector 20. The plate element 46 is moved until the spring element 60 is compressed in a given manner. In a further step the snap ring 52 is shifted into the groove 36 of the fuel injector body 24.

For assembling the fuel injector assembly 40, the assembled fuel injector 20—including the plate element 46, snap ring 52 and the spring element 60—is shifted into the fuel injector cup 44 in a manner that the fuel injector cup 44 and the plate element 46 are in engagement with each other. Then, the screws 56 are screwed into the plate element 46. The position of the plate element 46 with respect to the fuel injector body 24 is fixed by means of the snap ring 52 and the compressed spring element 60 during shifting the fuel injector 20 into the fuel injector cup 44.

The axial assembly of the spring element 60 between the plate element 46 and shoulder 58 the fuel injector 20 enables a symmetric force transmission and a good stress distribution between the fuel injector 20 and the plate element 46 also in the assembled state of the fuel injector assembly 40. Furthermore, mechanical stress of the fuel injector cup 44, the screws 56 and sensitive parts of the fuel injector 20 may be avoided.

After the assembly process the inner surface 48 of the fuel injector cup 44 is in sealing engagement with the sealing ring 50, and a state as shown in FIG. 2 is obtained. After the assembly process fuel can flow through the fuel injector cup 44 into the fuel inlet portion 26 of the fuel injector 20 without fuel leakage.

Since the plate element 46 and the fuel injector cup 44 are immovable with respect to each other due to the connection by means of the screws 56, the snap ring 52 between the fuel injector body 24 and the plate element 46 prevents a movement of the fuel injector 20 relative to the fuel injector cup 44 in the first direction D1. As the spring element 60 is compressed in a given manner after the assembly process of the fuel injector assembly 40 a movement of the fuel injector 20 relative to the fuel injector cup 44 in the second direction D2 may be prevented or at least largely prevented even in the case of large forces on the fuel injector 20 during operation, for example in the case of a high pressure or high pressure rise in the combustion chamber of the internal combustion engine 22.

The invention is not limited to specific embodiments by the description on the basis of said exemplary embodiments but comprises any combination of elements of different embodiments. Moreover, the invention comprises any combination of claims and any combination of features disclosed by the claims.

What is claimed is:

1. A fuel injector comprising:

a fuel injector body having a central longitudinal axis and a shoulder extending radially from the body, a plate element coupled to a fuel injector cup by at least one screw passing through corresponding holes in the fuel injector cup and the plate element, wherein the fuel injector body extends through a through hole of the plate element, a sealing ring engaged between the fuel injector cup and the fuel injector body to restrict flow from the fuel injector cup into an interior of the fuel injector body, a snap ring engaged with the plate element and a groove in the fuel injector body to block a movement of the fuel injector body relative to the plate element in a first direction away from the fuel injector cup along the central longitudinal axis, the groove remote from the shoulder and the sealing ring, and a spring element engaged with the shoulder of the fuel injector body and a face of the plate element to bias the fuel injector away from the plate element and to resist movement of the fuel injector in a second direction of the central longitudinal axis opposing the first direction of the central longitudinal axis to retain the plate element in a fixed position relative to the fuel injector body, wherein the spring element comprises an annular section in contact with the plate element, the annular section defining an outer perimeter, and wherein the outer perimeter includes a plurality of notches into the annular section eliminating direct mechanical contact between the spring element and the at least one screw, wherein the annular section in contact with the plate element extends completely circumferentially around the fuel injector body, and wherein the spring element further comprises at least two first legs and at least two second legs arranged mirror-symmetrically with respect to a mirror plane comprising the central longitudinal axis, wherein an end portion of each of the at least two first legs is in contact with the fuel injector and an end portion of each of the at least two second legs bears on the respective end portion of each of the at least two first legs.

2. The fuel injector of claim 1, wherein the respective first leg and the respective second leg together form a closed round shape.

3. The fuel injector of claim 1, wherein the spring element is arranged axially between the shoulder and the plate element.

4. The fuel injector of claim 3, wherein each of the spring element and the shoulder is formed from a material which comprises a metal, and wherein the shoulder and the spring element form a metal to metal contact area.

5. The fuel injector of claim 1, wherein the plate element comprises a second groove, and wherein the snap ring is arranged in the second groove.

6. A fuel injector assembly, comprising: a fuel injector comprising a fuel injector body having a central longitudinal axis and a shoulder extending radially from the body, a plate element, wherein the fuel injector body extends through a through hole of the plate element, a sealing ring engaged between a fuel injector cup and the fuel injector body to restrict flow from the fuel injector cup into an interior of the fuel injector body, a snap ring engaged with the plate element and a groove in the fuel injector body to block a movement of the fuel injector body relative to the plate element in a first direction away from the fuel injector cup along the central longitudinal axis, the groove remote from both the shoulder and the sealing ring in an axial direction along the fuel injector body, a spring element engaged with the shoulder of the fuel injector body a face of the plate element to bias the fuel injector away from the plate element and to resist movement of the fuel injector in a second direction of the central longitudinal axis opposing the first direction of the central longitudinal axis to retain the plate element in a fixed position relative to the fuel injector body, and a coupling device for hydraulically and mechanically coupling the fuel injector to a fuel rail of a combustion engine, the coupling device comprising the fuel injector cup configured for hydraulic coupling to the fuel rail and for engagement with a fuel inlet portion of the fuel injector, wherein the fuel injector cup is fixedly coupled to the plate element by at least one screw passing through corresponding holes in the fuel injector cup and the plate element, wherein the fuel injector is retained in the fuel injector cup and a movement of the fuel injector relative to the fuel injector cup in the first direction of the central longitudinal axis is blocked by means of mechanical interaction of the fuel injector body with the fuel injector cup via the plate element and the snap ring, and wherein the spring element comprises an annular section in contact with the plate element, the annular section defining an outer perimeter, and wherein the outer perimeter includes a plurality of notches into the annular section eliminating direct mechanical contact between the spring element and the at least one screw, wherein the annular section in contact with the plate element extends completely circumferentially around the fuel injector body, and wherein the spring element further comprises at least two first legs and at least two second legs arranged mirror-symmetrically with respect to a mirror plane comprising the central longitudinal axis, wherein an end portion of each of the at least two first legs is in contact with the fuel injector and an end portion of each of the at least two second legs bears on the respective end portion of each of the at least two first legs.

7. The fuel injector of claim 6, wherein the spring element is configured to prevent a movement of the fuel injector relative to the fuel injector cup in the second direction of the central longitudinal axis opposing the first direction of the central longitudinal axis by mechanical interaction of the fuel injector body with the fuel injector cup via the plate element and the spring element.

8. A method for assembling a fuel injector assembly, the method comprising: assembling a fuel injector comprising: a fuel injector body having a central longitudinal axis and a shoulder extending radially from the body, a plate element with a through hole, wherein the injector body extends through the through hole, a sealing ring engaged between the fuel injector cup and the fuel injector body to restrict flow from a fuel injector cup into an interior of the fuel injector body, a snap ring engaged with the plate element and a groove in the injector body to block a movement of the fuel injector body relative to the plate element in a first direction away from the fuel injector cup along the central longitudinal axis, the groove remote from both the shoulder and the sealing ring along the central longitudinal axis, and a spring element engaged with the shoulder of the fuel injector body and a face of the plate element to bias the fuel injector away from the plate element and to resist movement of the fuel injector in a second direction along the central longitudinal axis opposing the first direction to retain the plate element in a fixed position relative to the fuel injector body, and subsequently coupling a fuel injector cup to the plate element using at least one screw passing through corresponding holes in the fuel injector cup and the plate element, and wherein the spring element comprises an annular section in contact with the plate element, the annular section defining an outer perimeter, and wherein the outer perimeter includes a plurality of notches into the annular section eliminating direct mechanical contact between the spring element and the at least one screw, wherein the annular section in contact with the plate element extends completely circumferentially around the fuel injector body, and wherein the spring element further comprises at least two first legs and at least two second legs arranged mirror-symmetrically with respect to a mirror plane comprising the central longitudinal axis, wherein an end portion of each of the at least two first legs is in contact with the fuel injector and an end portion of each of the at least two second legs bears on the respective end portion of each of the at least two first legs.

9. A fuel injector comprising: a fuel injector body having a central longitudinal axis, a plate element to couple the fuel injector body to a fuel injector cup, the plate element fixedly connected to the fuel injector cup with at least one screw passing through corresponding holes in the fuel injector cup and the plate element and axially movable with respect to the fuel injector body, a sealing ring engaged between the fuel injector cup and the fuel injector body to restrict flow from the fuel injector cup into an interior of the fuel injector body, a snap ring blocking movement of the fuel injector body relative to the plate element in a first direction away from the fuel injector cup along the central longitudinal axis, and a spring element biasing the plate element in a second direction opposite the first direction along the central longitudinal axis, thereby retaining the plate element in a fixed position relative to the fuel injector body during alignment of the plate element with the fuel injector cup, wherein the spring element includes an annular section extending along a complete circumference of the fuel injector body in contact with the plate section and a first leg and a second leg extending away from the annular section, wherein the first leg contacts the fuel injector body and the second leg includes a first end portion connected to the annular section and a second end portion bearing on the first leg at a point remote from the annular section of the spring element, the second end portion moving in sliding contact with the first leg as the spring element compresses or stretches, and wherein the spring element comprises an annular section in contact with the plate element, the annular section defining an outer perimeter, and wherein the outer perimeter includes a plurality of notches into the annular section eliminating direct mechanical contact between the spring element and the at least one screw, wherein the annular section in contact with the plate element extends completely circumferentially around the fuel injector body, and wherein the spring element further comprises at least two first legs and at least two second legs arranged mirror-symmetrically with respect to a mirror plane comprising the central longitudinal axis, wherein an end portion of each of the at least two first legs is in contact with the fuel injector and an end portion of each of the at least two second legs bears on the respective end portion of each of the at least two first legs.

* * * * *